US005503588A

United States Patent [19]

Sweet

[11] Patent Number: 5,503,588

[45] Date of Patent: Apr. 2, 1996

[54] METHOD OF SHARPENING CUTTING BLADES

[75] Inventor: George M. Sweet, Chester, S.C.

[73] Assignee: The Gleason Works, Rochester, N.Y.

[21] Appl. No.: 85,515

[22] Filed: Jun. 30, 1993

[51] Int. Cl.[6] ..... B24B 1/00

[52] U.S. Cl. ..... 451/5; 451/48; 451/10

[58] Field of Search ..... 51/165.71, 165.76, 51/98 BS, 109 BS, 225, 288, 125; 451/48, 5, 10, 374, 48, 278, 293, 234

[56] References Cited

U.S. PATENT DOCUMENTS

| | | | |
|---|---|---|---|
| 2,828,583 | 4/1958 | Carlsen et al. . | |
| 3,098,333 | 7/1963 | Hannum | 51/225 |
| 3,136,093 | 6/1964 | Deprez . | |
| 3,192,604 | 7/1965 | Whitmore . | |
| 3,268,980 | 8/1966 | Blakesley et al. . | |
| 3,881,889 | 5/1975 | Hunkeler | 51/288 |
| 4,144,678 | 3/1979 | Ellwanger et al. | 51/288 |
| 4,170,091 | 10/1979 | Ellwanger et al. | 51/5 D |
| 4,183,182 | 1/1980 | Kotthaus | 51/288 |
| 4,186,529 | 2/1980 | Huffman | 51/288 |
| 4,607,462 | 8/1986 | Murphy | 51/213 |
| 5,088,243 | 2/1992 | Krenzer . | |
| 5,168,661 | 12/1992 | Pedersen et al. | 51/285 |
| 5,310,295 | 5/1994 | Palmateer, Jr. et al. | 409/13 |

*Primary Examiner*—Jack W. Lavinder
*Attorney, Agent, or Firm*—Robert L. McDowell; Ralph E. Harper

[57] ABSTRACT

A method of sharpening face-sharpened cutting blades for gears and the like comprising engaging a rotating grinding wheel and the cutting blade in a manner whereby the grinding wheel traverses across the cutting face along a grinding path wherein at least a portion of the grinding path is defined by a feed vector directed generally toward the cutting edge, with respect to the axis of rotation of the grinding wheel. The feed vector comprises components of (1) a first axis located in the sharpening plane and extending substantially perpendicular to the top of the cutting face, and, (2) a second axis located in the sharpening plane with the second axis being substantially perpendicular to the first axis. Preferably, the feed vector is directed perpendicular to the cutting edge.

18 Claims, 3 Drawing Sheets

METHOD OF SHARPENING CUTTING BLADES

FIELD OF THE INVENTION

The present invention relates to sharpening cutting blades such as those cutting blades utilized in the production of gears and the like.

BACKGROUND OF THE INVENTION

Cutters having face-sharpened cutting blades have been used for many years in processes for producing gears, particularly spiral bevel and hypoid gears and the like.

Face mill cutters of the form-relieved face-sharpened type comprise a plurality of cutting blades extending in an axial direction from one side of a cutter head with the cutting blades usually arranged and spaced equidistantly about the cutter head. The cutter head itself is adapted to be secured to the rotary cutter spindle carried by a machine tool. Each cutting blade includes a front face and a cutting edge formed by the intersection of the front face with the top and side surface of the cutting blade. A clearance edge is also present on the front face with the clearance edge being relieved from the cutting edge by a particular rake angle.

The cutting blades, which are usually releasably secured to the cutter head, may be blades known as outside blades which cut the concave side of the teeth of a work gear, or, the blades may be those known as inside blades which cut the convex side of the work gear teeth. Examples of face mill cutters having outside blades and face mill cutters having inside blades are shown in U.S. Pat. No. 3,192,604 to Whitmore. Alternatively, cutting blades and cutter heads may be of unitary construction, formed from a solid body of material such as high speed steel.

Another type of face mill cutter is shown by U.S. Pat. No. 3,268,980 to Blakesley et al. wherein cutters for roughing and cutters for finishing are shown in which both outside and inside cutting blades are alternatively arranged about a cutter head. This type of cutter forms the entire tooth slot between adjacent teeth on a work gear since each pair of inside and outside blades forms the opposite sides of adjacent teeth.

As with any cutter, continued use of form-relieved face mill cutters causes the cutting blades to become dull and therefore they must be periodically sharpened. It therefore becomes necessary to sharpen each blade by removing an amount of stock material from the front face of each blade thus removing the worn cutting edge and forming a new sharpened edge at the intersection of the newly formed front face and the top and one side surface of the blade. The side and end faces on the cutting blades used in form-relieved face mill cutters are helicoids. When the front face surface is removed for sharpening purposes, the new front face profile has the same shape and radial position relative to the cutter axis as the prior profile; but, it is displaced axially toward the back of the cutter. When dealing with a set of blades mounted in a cutter head, they must all be equally spaced and the sharpening planes must all have equal spacing.

One method of sharpening form-relieved type cutting blades is disclosed in U.S. Pat. No. 3,136,093 to Deprez in which a grinding wheel is traversed side-to-side across the width of the cutting face of a cutting blade.

Another known sharpening process for face-sharpened cutting blades is disclosed by U.S. Pat. No. 2,828,583 to Carlsen et al. in which a grinding wheel is oscillated across the cutting face of a cutting blade with each grinding stroke following a different path than the preceding stroke. The stated purpose of this method is to reduce or eliminate burrs of the cutting edge.

Yet another known sharpening process for face-sharpened cutting blades comprises feeding a grinding wheel in a straight line along the height of blade face, from the top of a cutting blade to the base of the blade face. In an opposite manner, a grinding wheel may be fed into the face of a cutting blade at the base of the blade face and then traversed along the height of the face to the top of the blade.

In the above described methods, burrs at the cutting edge are prevalent after sharpening. The burrs are generally tightly adhered to the cutting edge. Even after deburring operations, usually comprising lightly stroking the cutting edge with a soft steel or brass bar, remnants of the burrs remain. The tightly adhered burrs are believed to be caused by a welding action that takes place at the cutting edge largely due to excessive heat build-up caused by the grinding operation.

It is an object of the present invention to provide a method for sharpening face-sharpened cutting blades wherein any burrs formed at the cutting edge are reduced in size with those burrs present being loosely bonded to the cutting edge and easily removed by subsequent deburring operations.

SUMMARY OF THE INVENTION

The present invention is directed to a method of sharpening face-sharpened cutting blades of the type having a cutting face, two side surfaces and a top surface with a cutting edge being defined by the intersection of said cutting face and one of the side surfaces.

The method comprises engaging a rotating grinding wheel and the cutting blade in a manner whereby the grinding wheel traverses across the cutting face along a grinding path wherein at least a portion of the grinding path is defined by a feed vector directed generally toward the cutting edge, with respect to the axis of rotation of the grinding wheel. The feed vector comprises components of a first axis located in the sharpening plane and extending substantially perpendicular to the top of the cutting face, and a second axis located in the sharpening plane with the second axis being substantially perpendicular to the first axis. Preferably, the feed vector is directed perpendicular to the cutting edge.

The sharpening process of the present invention results in the formation of smaller burr on the cutting edge with the resulting burr being easier to remove than those burrs present after prior art sharpening processes.

DETAILED DESCRIPTION OF THE PREFERRED EMBODIMENTS

The present invention will now be discussed with reference to the accompanying Figures.

Figure 1:
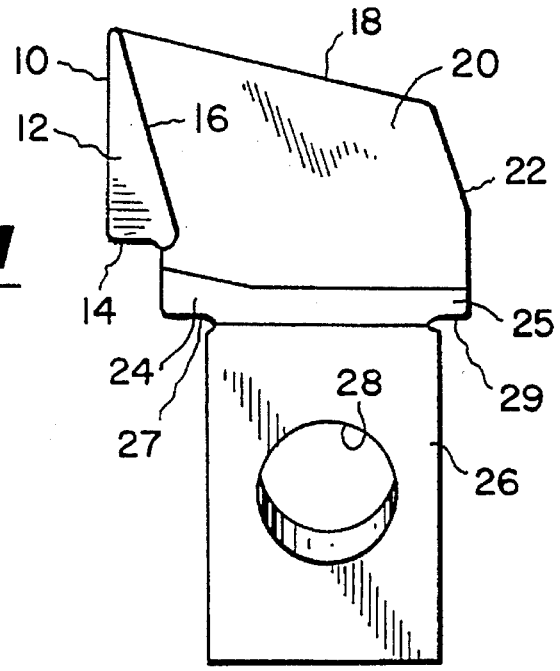
FIG. 1 illustrates one type of face-sharpened cutting blade.

A cutting blade of the face-sharpened type is shown in FIG. 1, which illustrate an outside cutting blade, comprising a cutting edge 10 located at the juncture of the front or sharpening face 12 and cutting side surface (not shown). The cutting edge 10 extends from the base 14 of the front face 12 to the top edge 18. Each blade also comprises a non-cutting or clearance edge 16, a clearance side surface 20, and a back face 22.

The shank of the cutting blade is generally T-shaped and comprises arms which constitute abutments 24 and 25 and a stem 26. Abutments 24 and 25 include, respectively, surfaces 27 and 29 which seat against the front face of a cutter head when the cutter blade is inserted into a slot in the cutter head. Each cutter blade is secured to the cutter head by a screw which extends generally at an angle through opening 28 in the stem 26 and into threaded engagement with a cutter head.

Figure 2:
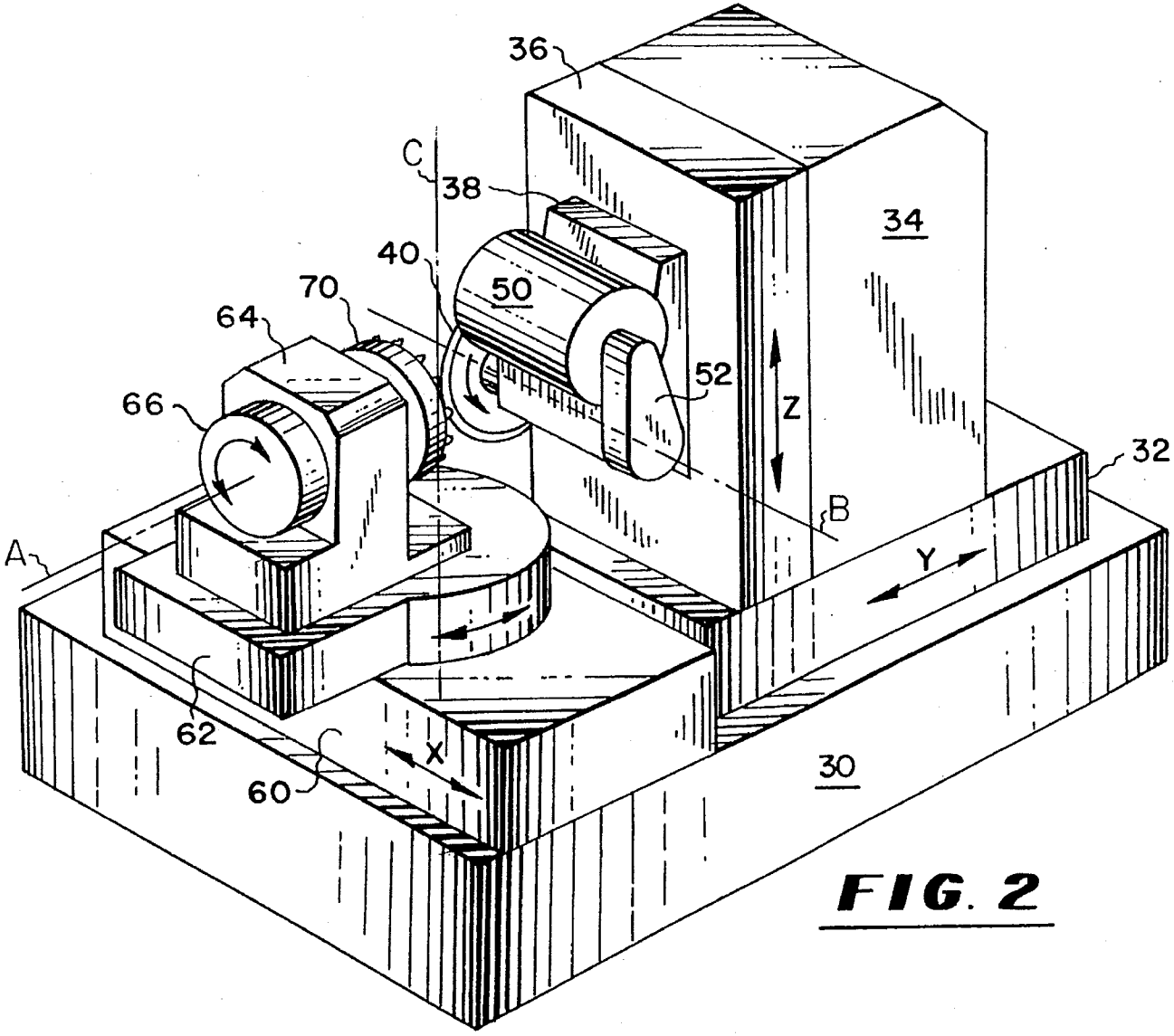
FIG. 2 schematically shows a machine for carrying out the present inventive method.

A sharpening or grinding machine for carrying out the present inventive process is schematically illustrated by FIG. 2. A preferred machine for carrying out the present inventive process is one having computer numerical control (CNC), an example of which is described below. Such machines are well known in the art and are readily available.

The machine comprises a base 30 upon which a tool carriage 32 is mounted via slides or ways (not shown). The tool carriage 32 is movable on the slides along the machine base 30 in a direction Y (Y-axis). Located on tool carriage 32 is a tool column 34 to which is mounted tool slide 36, via ways or slides (not shown), for movement in a direction Z (Z-axis) perpendicular to the Y-axis movement of tool carriage 32. A tool head 38 is secured to tool slide 36 and an appropriate stock removing tool, such as a grinding wheel 40, is mounted for rotation to the tool head 38. The grinding wheel 40 is rotatable about an axis B and is driven by a motor 50 acting through suitable reduction belts 52.

Also mounted via slides or ways (not shown) to machine base 30 is a first workpiece carriage 60 which is movable along the machine base 30 in a direction X (X-axis) perpendicular to both the Y-axis and Z-axis movements. A second workpiece carriage 62 is pivotably mounted to the first workpiece carriage 60 and is pivotable about an axis C. Secured to the second workpiece carriage 62 is workpiece column 64 in which a spindle (not shown) is journaled for rotation about axis A and is driven by a motor (not shown). A cutter 70 is releasably mounted to the spindle for rotation about the A-axis.

Relative movement of the tool 40 and cutter 70 along each of the mutually perpendicular axes X, Y, and Z is imparted by respective drive motors (not shown) which act through speed reducing gearing and recirculating ball screw drives (not shown). Pivoting of the second workpiece carriage 62 about the C-axis is imparted by a drive motor (not shown) acting through a worm which engages with a worm wheel carried by the pivotable workpiece carriage 62.

Each of the respective drive motors, except the tool drive motor 50, is associated with either a linear or rotary encoder as part of a CNC system which governs the operation of the drive motors in accordance with input instructions input to a computer. The encoders provide feedback information to the computer concerning the actual positions of each of the movable machine axes. CNC systems for controlling the movement of multiple machine axes along prescribed paths are now commonplace. Such state-of-the-art systems are incorporated in the present invention to control movements of selected axes along selected paths for sharpening the blades of a form-relieved type face mill cutter in accordance with the present inventive process.

Figure 3A:
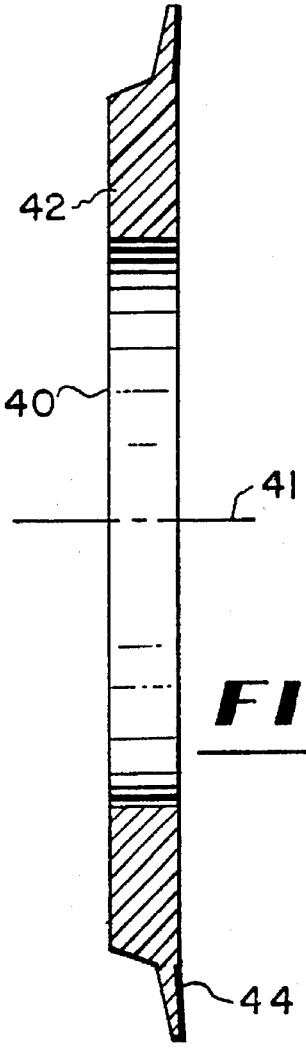
FIGS. 3*a* and 3*b* illustrate a disc-shaped grinding wheel utilized in the present sharpening process.

FIG. 3*a* illustrates a cross-sectional view of a generally disc-shaped grinding wheel 40 suitable for sharpening face-sharpened cutting blades according to the present invention. The grinding wheel 40 has an axis of rotation 41, a steel body 42 and a grinding profile 44 comprising abrasive material, such as resin bonded cubic boron nitride (CBN), located on the periphery and a portion of the face of the grinding wheel.

Figure 3B:
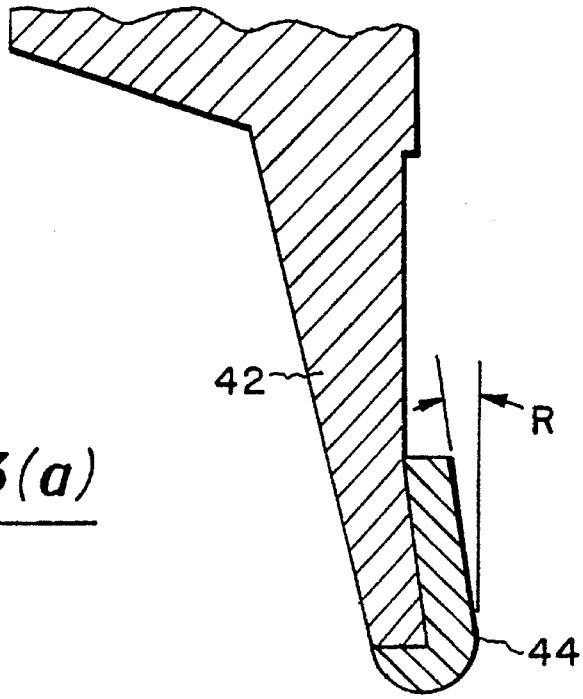

FIG. 3*b* shows an enlarged cross-sectional view of the grinding profile 44 where it can be seen that the portion of the grinding profile 44 located on the face of the grinding wheel 40 is inclined at an angle R of about 6 degrees, with respect to a line perpendicular to axis 41. The diameter of the grinding wheel 40 is generally about 12 inches (305 mm) although any diameter grinding wheel may be used depending upon the particulars of the sharpening process, for example, machine component clearance allowances or size of cutting blade.

Figure 4:
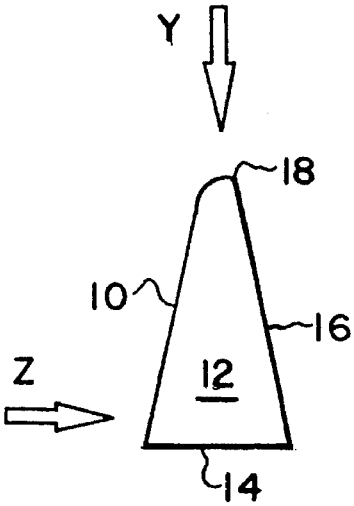
FIG. 4 depicts known prior art sharpening processes.

FIG. 4 shows the cutting face 12 of a cutting blade having cutting edge 10, top 18, base 14 and clearance edge 16. Cutting face 12 lies in a sharpening plane which in this instance is the plane of the paper. For discussion and reference purposes only, the cutting blade is shown in an upright position with respect to the top of the paper, Y and Z are perpendicular to one another and have been assigned to indicate orientations with respect to the cutting blade. The Y axis is essentially perpendicular to the top 18 of the cutting face 12 in the sharpening plane. Also for purposes of reference, the height of the cutting blade is intended to refer to the top-to-base dimension while the width of the cutting blade is intended to refer to the cutting edge-to-clearance edge dimension. It is to be understood that the present invention is not limited to the particular illustrated cutting blade position or orientation nomenclature.

In the prior art sharpening methods discussed previously, one method was to traverse the grinding wheel across the face 12 of the cutting blade along the Y axis starting at the top 18 and proceeding along the height toward the base 14 or, alternatively, plunging the grinding wheel in near the base 14 and traverse across the height of the blade in a direction toward the top 18. In either instance, feeding of the grinding wheel takes place in the Y direction.

In U.S. Pat. Nos. 2,828,583 and 3,136,093 discussed above, sharpening takes place along the Z axis as the grinding wheel traverses across the width of the cutting blade face 12.

Both of these methods result in burrs being formed on the cutting edge 10 with these burrs being essentially welded to the cutting edge. A burr with such a bond is very difficult to remove and even after deburring procedures, remnants of the burrs remain on the cutting edge 10. Remnants of burrs will adversely affect truing devices used after sharpening to radially align cutting blades mounted in a cutter head since such truing devices measure distances from the cutter axis to the blade cutting edge. With burrs present, the actual position of the cutting edge cannot be accurately measured and a cutter cannot, therefore, be accurately trued.

It is believed that sharpening along either the Y or Z axis causes a significant heat build-up at the cutting edge of the cutting blade particularly in situations where oil-based lubricants and coolants are utilized. When a grinding wheel is fed across the cutting face along the Z axis, contact occurs first on the wider portion of the cutting face 12 in the vicinity of the base 14 and causes heat to flow upward toward the top 18 which concentrates heat in the narrower upper portion of the cutting blade including the cutting edge 10. Plunging a grinding wheel into the cutting face 12 near the base 14 and then traversing across the face to the top 18 has an even more pronounced burr-forming effect as even more heat is directed toward the top portion of the cutting blade.

When a grinding wheel is traversed across the cutting face in a direction from the top 18 toward the base 14, generated heat moves into a larger heat sink due to the wider dimension of the lower portion of the cutting blade. However, there is still a noted heat build-up at the cutting edge 10 as the grinding wheel moves along from the top 18 toward the base 14 of the cutting face.

Oil-based lubricants and coolants generally do not absorb and transfer away heat as quickly as water-based substances and therefore the noted welding effect is especially pronounced when such oil-based lubricants and coolants are utilized.

Figure 5:
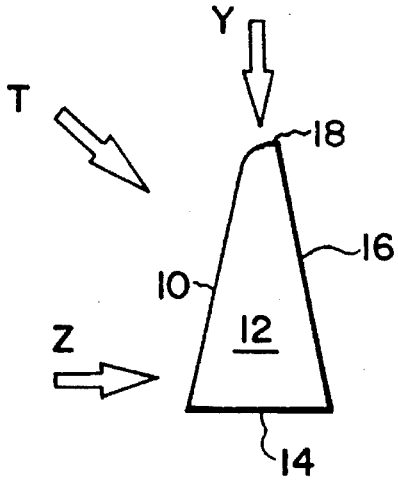
FIG. 5 illustrates the present invention showing inventive feed vector T.

FIG. 5 illustrates the present inventive sharpening process. The inventor has discovered that by feeding the grinding wheel across the cutting face 12 of a cutting blade along a path comprising components of both the Y and Z axes, the size of any burrs remaining after sharpening is diminished and these remnant burrs are easily and essentially completely removed by a deburring operation.

Specifically, at least a portion, and preferably all, of the feedpath of the grinding wheel comprises a feed vector T directed, with respect to the axis of the grinding wheel, generally toward the cutting edge 10 of a cutting blade. The feed vector T comprises both Y and Z axis components. Hence, feed vector T can be thought of as lying between axes Y and Z. Preferably, the direction of feed vector T is essentially perpendicular to the cutting edge 10.

Figure 6:
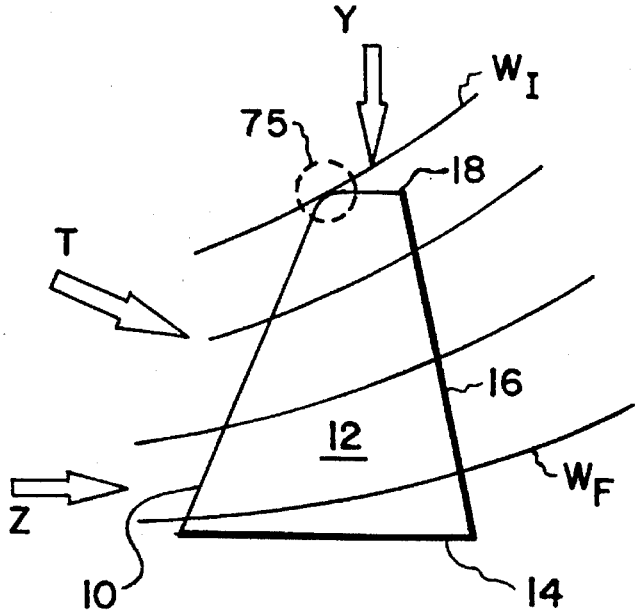
FIG. 6 illustrates a preferred embodiment of the present invention showing feed vector T directed perpendicular to the cutting edge.

FIG. 6 illustrates the preferred embodiment of the present invention wherein feed vector T is directed perpendicular to the cutting edge 10. The grinding wheel is fed from an initial contact position $W_I$ to a final position $W_F$ along a path defined by feed vector T which is directed essentially perpendicular to cutting edge 10. Of course, it is understood that the feed vector T may be positioned at any location in the sharpening plane without changing the direction thereof. Such position changes may be due to, for example, grinding wheel diameter or desired initial contact location with the cutting blade. Preferably, as shown by reference number 75 in FIG. 6, the position of the grinding wheel is such that initial contact of the grinding wheel with the cutting face 12 occurs in the vicinity of the junction of cutting edge 10 and top 18 and the grinding wheel is fed across the cutting face 12 of the cutting blade along a path dictated by feed vector T.

The present method is preferably carried out by mounting a cutter, having one or more face-sharpened cutting blades mounted thereon, to the work spindle of a CNC sharpening machine such as shown in FIG. 2. Initial setup positions are then computed in response to setup parameters input to the machine, and the computer controlled axes are moved to the setup positions to initially position the grinding wheel and a cutting blade with respect to one another. Operating positions are then computed in response to operating parameters input to the machine and the machine axes are moved to these operating positions to traverse the grinding wheel across the cutting face of the cutting blade along a grinding path at least a portion of which comprises a feed vector T having Y and Z components (FIGS. 5 and 6). The steps of computing operating positions and moving the computer controlled axes to these operating positions are repeated as many times as necessary to complete the sharpening process. The cutter may then be indexed to an unsharpened cutting blade and the process is repeated.

A cutting blade sharpened by this method, with oil-based coolant, along a feed vector T directed essentially perpendicular to cutting edge 10 had burrs present on the cutting edge after sharpening of 0.000875 inch (0.022225 mm) in height. After a deburring operation, comprising a stroke of a soft steel bar along the cutting edge 10, no measurable burr remained.

Comparatively, sharpening a cutting blade by the prior art process, with oil-based coolant, comprising feeding a grinding wheel into the cutting blade face at the base 14 and traversing along the height of the cutting face 12 to the top 18 (Y-axis feed) yielded after-sharpening burrs on the cutting edge of 0.0012 inch (0.03048 mm) in height. After a deburring step, as described above, burrs of 0.000175 inch (0.004445 mm) remained.

The present invention allows the cutting edge to remain relatively cool so that the occurrence of burrs being welded to the cutting edge is greatly reduced or eliminated. This is believed due to several reasons. The first reason being that at the early portion of the sharpening process, contact area between the grinding wheel and cutting face is small thus generating little heat. The contact area builds in stages with full contact, and hence the greatest heat generation, existing only at the end of the sharpening cycle when the grinding wheel is located at position $W_F$.

Another reason for the benefits realized by the present invention is that the vector approach effectively drives heat in a direction generally perpendicular to the cutting edge 10. Furthermore, the angled feedpath in combination with the angled cutting edge 10 appears to produce burr breaking action that essentially wipes away some burrs as soon as they are formed.

The present invention enables smooth cutting edges to be achieved after sharpening with, at most, a simple deburring operation needed. Costly and time consuming post-sharpening finish grinding sequences are eliminated. The inventive sharpening method enables cutters to be trued based on the actual cutting edges of the blades and better parts may be obtained due to improved run-out characteristics of the cutters.

Although the present invention has been illustrated by showing an outside cutting blade for a left-hand cutter (or an inside cutting blade for a right-hand cutter), the present inventive method is equally applicable to cutting blades having a cutting edge on the opposite side of that illustrated in the Figures, namely, inside blades for left-handed cutters and outside blades for right-handed cutters. The feed vector T is directed toward the cutting edge, regardless of the location of the cutting edge, and comprises both Y and Z axis components. The present invention also includes feeding a grinding wheel along the feed vector T directed toward the cutting edge, preferably generally about perpendicular thereto, with initial contact being on the clearance edge side of the cutting blade and movement of the grinding wheel being toward the cutting edge.

While the invention has been described with reference to preferred embodiments it is to be understood that the invention is not limited to the particulars thereof. The present invention is intended to include modifications which would be apparent to those skilled in the art to which the subject matter pertains without deviating from the spirit and scope of the appended claims.

What is claimed is:

1. A method of sharpening face-sharpened cutting blades, said cutting blades having a cutting face, two side surfaces and a top surface with a cutting edge being defined by the intersection of said cutting face and one of said side surfaces and a clearance edge being defined by the intersection of said cutting face and the other of said side surfaces, said method comprising:

providing a grinding wheel, said grinding wheel having an axis of rotation, providing said cutting blade having said cutting face, said cutting face defining a sharpening plane, rotating said grinding wheel, engaging said rotating grinding wheel and said cutting blade in a manner whereby said grinding wheel traverses across said cutting face along a grinding path, wherein at least a portion of said grinding path is defined by a feed vector directed generally toward said cutting edge with said feed vector comprising a first component lying on a first axis located in said sharpening plane, said first axis extending substantially perpendicular to said top of said cutting face and a second component lying on a second axis located in said sharpening plane with said second axis being substantially perpendicular to said first axis.

2. The method of claim 1 wherein said feed vector is directed substantially perpendicular to said cutting edge.

3. The method of claim 1 wherein said grinding wheel first contacts said cutting face in the vicinity of the intersection of said cutting edge and said top.

4. The method of claim 1 wherein said sharpening is carried out with an oil-based coolant.

5. The method of claim 1 wherein the entire grinding path is defined by said feed vector.

6. The method of claim 1 wherein said grinding wheel first contacts said cutting face at said clearance edge.

7. The method of claim 6 wherein said feed vector is directed generally perpendicular to said cutting edge.

8. A method of sharpening face-sharpened cutting blades, said cutting blades having a cutting face, two side surfaces and a top surface with a cutting edge being defined by the intersection of said cutting face and one of said side surfaces and a clearance edge being defined by the intersection of said cutting face and the other of said side surfaces, said method comprising:

providing a grinding wheel, said grinding wheel having an axis of rotation, providing said cutting blade having said cutting face, said cutting face defining a sharpening plane, rotating said grinding wheel, engaging said rotating grinding wheel and said cutting blade in a manner whereby said grinding wheel traverses across said cutting face along a grinding path, wherein at least a portion of said grinding path is defined by a feed vector directed substantially perpendicular to said cutting edge with said feed vector comprising a first component lying on a first axis located in said sharpening plane said first axis extending substantially perpendicular to said top of said cutting face and a second component lying on a second axis located in said sharpening plane with said second axis being substantially perpendicular to said first axis.

9. The method of claim 8 wherein said grinding wheel first contacts said cutting blade in the vicinity of the intersection of said cutting edge and said top.

10. The method of claim 8 wherein the entire grinding path is defined by said feed vector.

11. The method of claim 8 wherein said grinding wheel first contacts said cutting face at said clearance edge.

12. A method of sharpening face-sharpened cutting blades with a computer controlled machine having a plurality of computer controlled axes for positioning and operatively engaging a tool and workpiece with respect to one another, said tool comprising a grinding wheel and said workpiece comprising a cutter having at least one cutting blade mounted thereon, each of said at least one cutting blade having a cutting face defining a sharpening plane, two side surfaces and a top surface with a cutting edge being defined by the intersection of said cutting face and one of said side surfaces and a clearance edge being defined by the intersection of said cutting face and the other of said side surfaces, said method comprising:

computing initial setup positions in response to setup parameters input to said machine, moving said computer controlled axes to said setup positions to initially position the grinding wheel and a cutting blade with respect to one another, computing operating positions in response to operating parameters input to the machine, moving said machine axes to said operating positions to traverse said grinding wheel across said cutting face along a grinding path at least a portion of which comprises a feed vector comprising a first component lying on a first axis located in said sharpening plane, said first axis extending substantially perpendicular to said top of said cutting face and a second component lying on a second axis located in said sharpening plane with said second axis being substantially perpendicular to said first axis, repeating the steps of computing operating positions and moving said computer controlled axes to said operating positions for completing said sharpening.

13. The method of claim 12 further including indexing said cutter to an unsharpened cutting blade and repeating the sharpening method.

14. The method of claim 12 wherein said feed vector is directed substantially perpendicular to said cutting edge.

15. The method of claim 12 wherein said grinding wheel first contacts said cutting blade in the vicinity of the intersection of said cutting edge and said top.

16. The method of claim 12 wherein the entire grinding path is defined by said feed vector.

17. The method of claim 12 wherein said grinding wheel first contacts said cutting face at said clearance edge.

18. The method of claim 17 wherein said feed vector is directed generally perpendicular to said cutting edge.

* * * * *